US008161951B2

(12) United States Patent
Mochida

(10) Patent No.: US 8,161,951 B2
(45) Date of Patent: Apr. 24, 2012

(54) INTERNAL COMBUSTION ENGINE

(75) Inventor: Hiroaki Mochida, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 741 days.

(21) Appl. No.: 12/233,141

(22) Filed: Sep. 18, 2008

(65) Prior Publication Data

US 2009/0101124 A1 Apr. 23, 2009

(30) Foreign Application Priority Data

Oct. 19, 2007 (JP) ..... 2007-272534

(51) Int. Cl.
*F02B 25/06* (2006.01)

(52) U.S. Cl. ..... 123/572; 123/90.38; 123/195 C

(58) Field of Classification Search ..... 123/572, 123/90.38, 195 C

See application file for complete search history.

(56) References Cited

U.S. PATENT DOCUMENTS 4,541,399 A 9/1985 Tanaka et al.
4,721,090 A * 1/1988 Kato ..... 123/572
4,945,887 A 8/1990 Sakurai et al.
2008/0047519 A1* 2/2008 Naito et al. ..... 123/193.5
2009/0159056 A1* 6/2009 Takeuchi ..... 123/574

FOREIGN PATENT DOCUMENTS

JP 58-44417 U 3/1983
JP 59-188019 A 10/1984
JP 62-85110 A 4/1987
JP 11-200831 A 7/1999

* cited by examiner

*Primary Examiner* — Marguerite McMahon
*Assistant Examiner* — James Kim
(74) *Attorney, Agent, or Firm* — Foley & Lardner LLP

(57) ABSTRACT

Blow-by gas in a plurality of crank chambers (71-73) in a V-shaped internal combustion engine is led to a plurality of gas introducing chambers (9*a*, 9*b*, 9*c*) via communicating holes (11-14). The blow-by gas then flows into an oil separator (31), which extends in a front-aft direction of the internal combustion engine, from the gas introducing chambers (9*a*, 9*b*, 9*c*). The blow-by gas inlet (33) of the oil separator (31) is provided in the vicinity of the engine front or the engine rear. By providing a guide member (35, 41) which guides the blow-by gas from the gas introducing chamber (9*a*) which is closest to the blow-by gas inlet (33) to the blow-by gas inlet (33) in a direction heading away from the blow-by gas inlet (33) and then guides it to the blow-by gas inlet (33), pumping loss in the internal combustion engine can be reduced.

12 Claims, 8 Drawing Sheets

INTERNAL COMBUSTION ENGINE

FIELD OF THE INVENTION

This invention relates to the processing of blow-by gas generated in an internal combustion engine.

BACKGROUND OF THE INVENTION

JPS62-085110A, published by the Japan Patent Office in 1987, discloses a blow-by gas processing device which collects blow-by gas blown out from cylinders to corresponding crank chambers of a V-shaped internal combustion engine in a gas introducing chamber which is disposed above the crank chambers and applies an oil separation process in an oil separator disposed above the gas introducing chamber. After separating an oil component in the oil separator, the blow-by gas is recirculated into an intake passage of the V-shaped internal combustion engine.

The gas-introducing chamber is formed in a space between a pair of cylinder banks of the V-shaped internal combustion engine. The V-shaped internal combustion engine comprises a plurality of crank chambers which are connected to the gas-introducing chamber via communicating holes.

SUMMARY OF THE INVENTION

The gas-introducing chamber allows gas to flow between the crank chambers via the gas-introducing chamber. Accompanying an operation of the internal combustion engine, each cylinder performs expansion and contraction, as a result of which a blow-by gas pressure in the respective crank chambers varies. The gas introducing chamber allows blow-by gas to flow between the crank chambers according to the variation in the blow-by gas pressure in the respective crank chambers, thereby reducing pumping loss of the internal combustion engine caused by variation in the blow-by gas pressure in the respective crank chambers.

The blow-by gas-processing device according to the prior art brings about a favorable effect with regard to separation of the oil component from the blow-by gas as well as a reduction in pumping loss in an internal combustion engine.

In the blow-by gas-processing device according to the prior art, however, a problem may arise when attempting to improve the oil component separation efficiency of the oil separator.

Specifically, in order to separate the oil component from the blow-by gas sufficiently using the oil separator, the flow length of the blow-by gas in the oil separator should be set long. To ensure a sufficient length in the blow-by gas passage of the oil separator, a blow-by gas inlet of the oil separator is preferably disposed at an end of the internal combustion engine and a blow-by gas outlet of the oil separator is preferably disposed in the vicinity of the opposite end of the internal combustion engine.

As a result, large difference occurs in the flow path distances from the respective crank chambers to the blow-by gas inlet of the oil separator. In a crank chamber which is closest to the blow-by gas inlet, the blow-by gas flows into the oil separator without flowing into the adjacent crank chamber when the blow-by gas pressure is high. However, differences in the flow path distances of the blow-by gas impair a pumping loss reduction effect brought about by the gas-introducing chamber in the internal combustion engine.

It is therefore an object of this invention to increase the oil separation efficiency of an oil separator without impairing a pumping loss reduction effect brought about by a gas-introducing chamber in a blow-by gas-processing device.

To achieve the above object, this invention provides a blow-by gas-processing device which collects blow-by gas from a plurality of crank chambers in an internal combustion engine. The blow-by gas processing device comprises an oil separator which separates an oil component contained in the blow-by gas. The oil separator comprises a blow-by gas inlet in the vicinity of the engine front or the engine rear. The blow-by gas processing device also comprises a gas introducing chamber which is disposed between the crank chambers and the blow-by gas inlet and connected to the crank chambers via communicating holes, and a guiding mechanism which guides the blow-by gas from a specific communicating hole which is closest to the blow-by gas inlet, to the blow-by gas inlet in a direction heading away from the blow-by gas inlet and then guides the blow-by gas to the blow-by gas inlet.

The details as well as other features and advantages of this invention are set forth in the remainder of the specification and are shown in the accompanying drawings.

DESCRIPTION OF THE PREFERRED EMBODIMENTS

Figure 1:
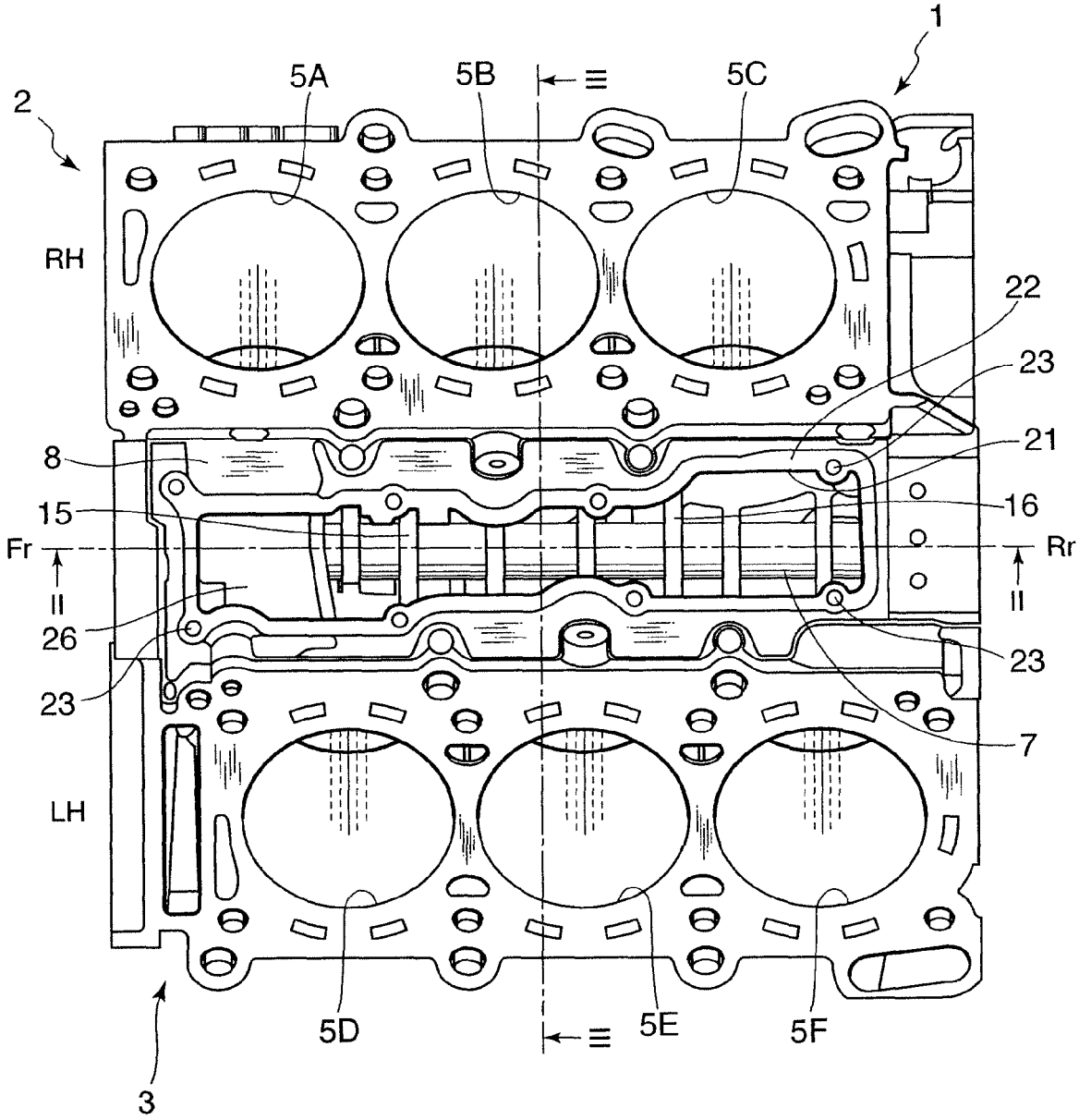
FIG. 1 is a plan view of a cylinder block of a V-shaped internal combustion engine provided with a blow-by gas-processing device according to this invention.

Referring to FIG. 1 of the drawings, a cylinder block 1 of a six-cylinder a V-shaped internal combustion engine comprises a right cylinder bank 2 which encloses three cylinders 5A, 5B, and 5C, and a left cylinder bank 3 which encloses three cylinders 5D, 5E, and 5F. Fr in the figure denotes an engine front and Rr in the figure denotes an engine rear. Accordingly, in each cylinder bank, the cylinders are aligned in a row in the front-aft direction of the internal combustion engine. The cylinders 5A, 5B, and 5C in the right cylinder bank 2 are shifted slightly towards the engine front with respect to the cylinders 5D, 5E, and 5F in the left cylinder bank 3.

Figure 3:
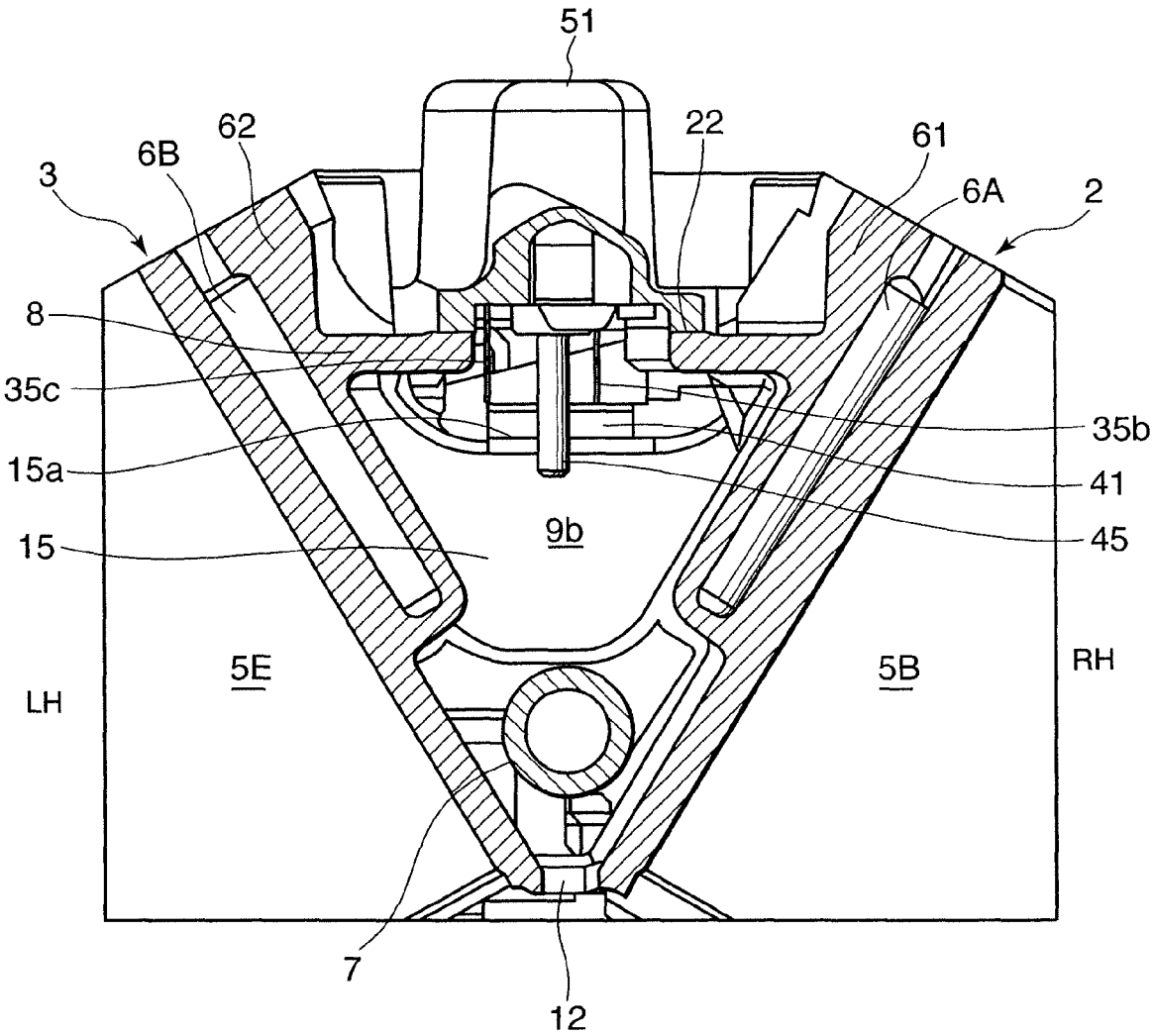
FIG. 3 is a cross-sectional view of the blow-by gas-processing device taken along a line III-III in FIG. 1.

Referring to FIG. 3, a water jacket 6A is formed in the right cylinder bank 2 on the inner side of the cylinders 5A, 5B, and 5C. A water jacket 6B is formed in the left cylinder bank 3 on the inner side of the cylinders 5D, 5E, and 5F.

A piston is enclosed in each of the six cylinders 5A-5F and caused to slide therein in an axial direction. For descriptive purposes, the cylinders 5A, 5B, and 5C in the right cylinder bank 2 are numbered as #1, #3, #5 and the cylinders 5D, 5E, and 5F in the left cylinder bank 3 are numbered as #2, #4, #6. These cylinder numbers represent the order of ignition.

A straight pipe-shaped main oil gallery 7 is formed in the cylinder block 1 at a joint portion of the bases of the two cylinder banks 2 and 3 in the front-aft direction of the internal combustion engine. A horizontal partition 8 is formed above the main oil gallery 7 to bridge two walls 61 and 62 of the right cylinder bank 2 and the left cylinder bank 3, which face to each other. A first gas introducing chamber 9*a*, a second gas introducing chamber 9*b*, and a third gas introducing chamber 9*c* each having a substantially triangular cross-sectional shape and extending over substantially the entire length of the cylinder block 1 are formed by the horizontal partition 8, the walls 61 and 62, and a cylinder block front wall 25 and a cylinder block rear wall 29 which are shown in FIG. 2.

Figure 2:
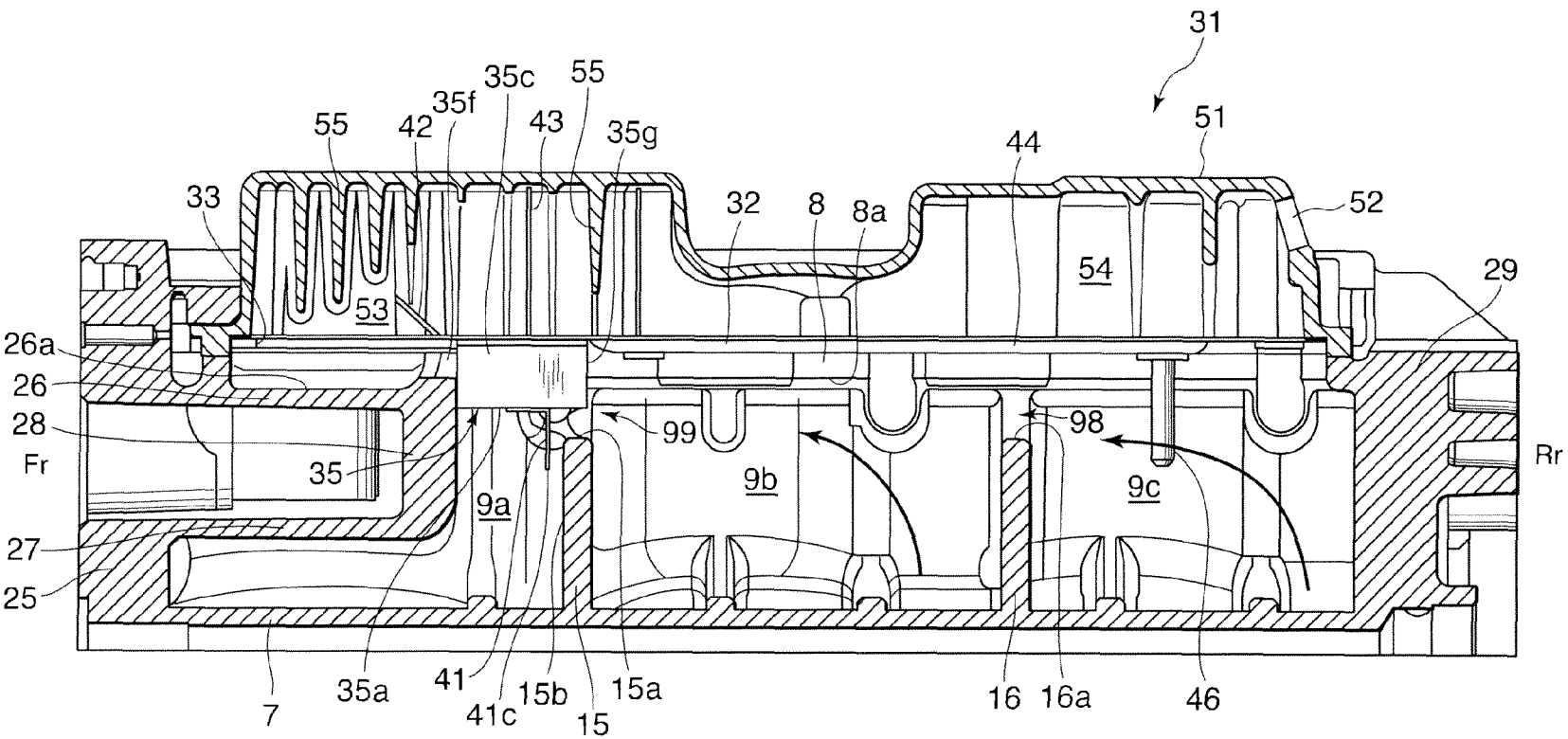
FIG. 2 is a longitudinal sectional view of the blow-by gas-processing device taken along a line II-II in FIG. 1.

Referring to FIG. 2, the gas introducing chambers 9*a*, 9*b*, and 9*c* are delimited almost evenly by reinforcing ribs 15 and 16 in the longitudinal direction of the cylinder block 1. The first reinforcing rib 15 is located on the engine front side between the first gas introducing chamber 9*a* and the second gas introducing chamber 9*b*. The second reinforcing rib 16 is located on the engine rear side between the second gas introducing chamber 9*b* and the third gas introducing chamber 9*c*. The first gas introducing chamber 9*a* and the second gas introducing chamber 9*b* communicate with each other via a gap 99 formed between an upper end 15*a* of the first reinforcing rib 15 and the horizontal partition 8. The second gas introducing chamber 9*b* and the third gas introducing chamber 9*c* communicate with each other via a gap 98 formed between an upper end 16*a* of the second reinforcing rib 16 and the horizontal partition 8.

Figure 4:
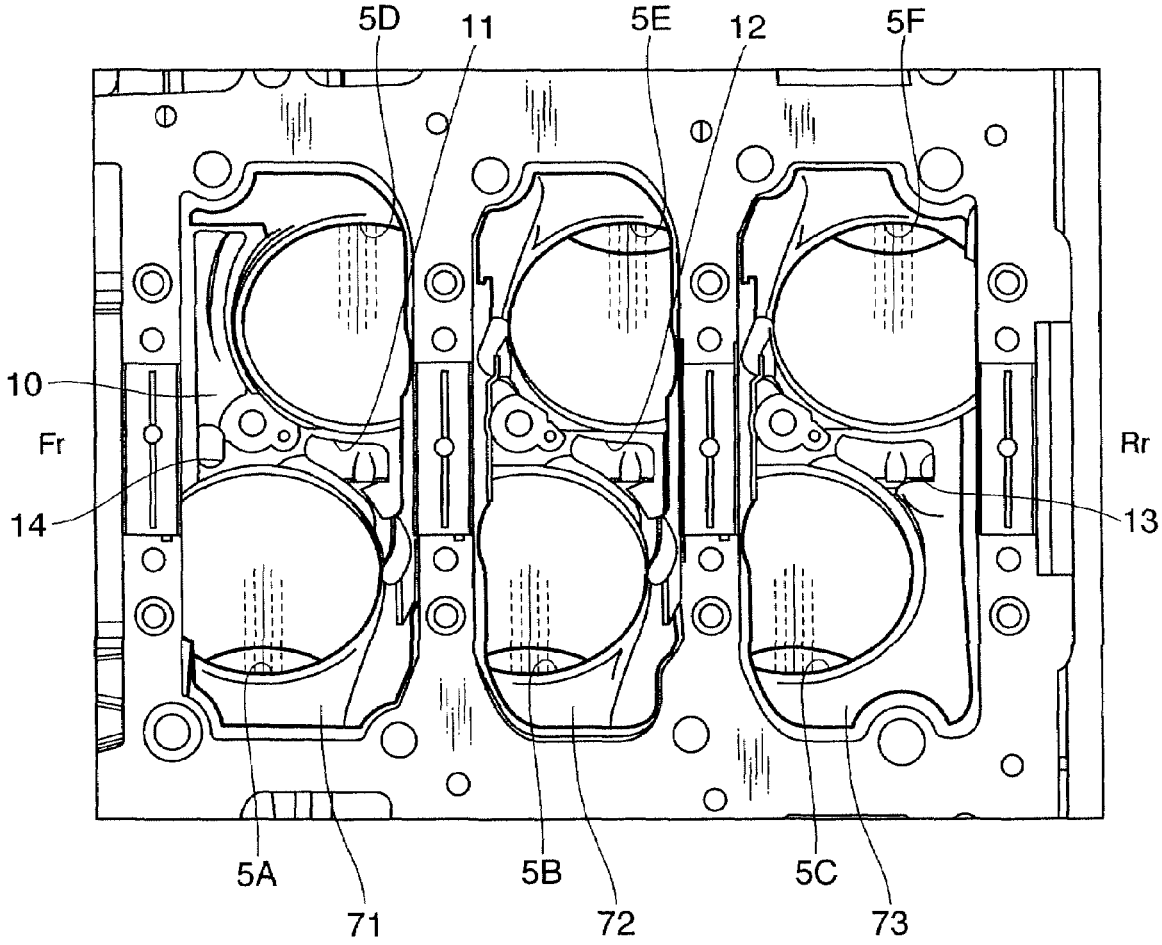
FIG. 4 is a plan view of the cylinder block viewed from below.

Referring to FIG. 4, crank chambers 71-73 are formed under the cylinders 5A-5F. The crank chamber 71 faces the cylinders 5A and 5D, the crank chamber 72 faces the cylinders 5B and 5E, and the crank chamber 7 faces the cylinders 5C and 5F. A crank case wall 10 is interposed between the crank chambers 71-73 and the gas introducing chambers 9*a*, 9*b*, 9*c*. A first communicating hole 11 connecting the crank chamber 71 and the first gas introducing chamber 9*a*, a second communicating hole 12 connecting the crank chamber 72 and the second gas introducing chamber 9*b*, and a third communicating hole 13 connecting the crank chamber 73 and the third gas introducing chamber 9*c* are formed respectively in the crank case wall 10. A fourth communicating hole 14 connecting the crank chamber 71 and the first gas introducing chamber 9*a* is also formed in the crank case wall 10 in front of the first communicating hole 11.

When the piston performs a down stroke in each cylinder 5A-5F, the capacity of the crank chamber located under the cylinder decreases and the pressure therein increases. When the piston performs an upstroke in the cylinder, the capacity of the crank chamber under the cylinder increases and the pressure therein decreases. As an air-fuel mixture burns in the six cylinders 5A-5F in the aforesaid ignition order, the pistons reciprocate in the up-down direction in the respective cylinders 5A-5F at a predetermined phase difference. As a result, the pressure in the respective crank chambers 71-73 increases and decreases repeatedly. If the crank chambers 71-73 are tightly closed, the energy used for the increase and decrease in the pressure leads to pumping loss. On the other hand, when gas is allowed to flow from a high-pressure crank chamber to a low-pressure crank chamber, the pressure variation in each crank chamber is smoothed out such that the pumping loss is reduced. The gap 99 between the upper end 15*a* of the first reinforcing rib 15 and the horizontal partition 8 connecting the gas introducing chambers 9*a* and 9*b*, and the gap 98 between the upper end 16*a* of the second reinforcing rib 16 and the horizontal partition 8 connecting the gas introducing chambers 9*b* and 9*c* as well as the communicating holes 11-14 allow gas to flow between the crank chambers 71-73 in this manner.

The reinforcing ribs 15 and 16 are formed integrally with the cylinder block 1. The reinforcing ribs 15 and 16 also have a function to enhance the rigidity of the two cylinder banks 2 and 3. Specifically, the reinforcing ribs 15 and 16 support a force acting on the upper ends of the two cylinder banks 2 and 3 in an approaching direction or a force acting on the cylinder banks 2 and 3 in a twisting direction.

When the air-fuel mixture burns in the cylinders 5A-5F, a part of a high-temperature combustion gas blows out from a combustion chamber above the piston into the crank chambers 71-73 by passing through a minute gap between the piston and a cylinder wall. Combustion gas that flows into the crank chambers 71-73 from the cylinders 5A-5F in this way is known as blow-by gas.

The blow-by gas is mixed with oil vapor in the crank chambers 71-73. The blow-by gas processing device according to this invention separates an oil component from the blow-by gas into which oil vapor is mixed and then recirculates the blow-by gas to an intake passage of the V-shaped internal combustion engine while returning the separated oil component to the crank chambers 71-73.

Specifically, the blow-by gas processing device introduces the blow-by gas in the crank chambers 71-73 to the corresponding gas introducing chambers 9*a*, 9*b*, 9*c* via the communicating holes 11-14.

Referring again to FIG. 2, the blow-by gas processing device comprises an oil separator 31 formed in a substantially rectangular solid shape above the horizontal partition 8 so as to separate the oil component from the blow-by gas introduced into the gas introducing chambers 9*a*, 9*b*, 9*c*. The oil separator 31 is disposed in a space between the two cylinder banks 2 and 3 above the horizontal partition 8, and does not therefore increase the size of the V-shaped internal combustion engine.

Referring again to FIG. 1, the horizontal partition 8 has a hole part 21 within a substantially rectangular shape which extends from the vicinity of the engine front to the vicinity of the engine rear. A fixing seat 22 having a predetermined width is formed around the periphery of the hole part 21. Eight bolt holes 23 are formed through the fixing seat 23, four on the right cylinder bank side and four on the left cylinder bank side.

Referring again to FIG. 2, the cylinder block 1 comprises two parallel transverse walls 26 and 27 projecting from the cylinder block front wall 25 into the first gas introducing chamber 9*a* and a vertical wall 28 connecting the transverse walls 26 and 27. The upper transverse wall 26 is located at a slightly lower level than the horizontal partition 8. A depression 26*a* is formed on the top surface of the transverse wall 26. The upper end of the vertical wall 28 projects upward beyond the transverse wall 26 so as to reach the horizontal partition 8. The vertical wall 28 has an opening on the upper part thereof. The lower transverse wall 27 is located above the main oil gallery 7 at a predetermined distance.

The hole part 21 is closed by a base plate 32 of the oil separator 31.

Figure 8:
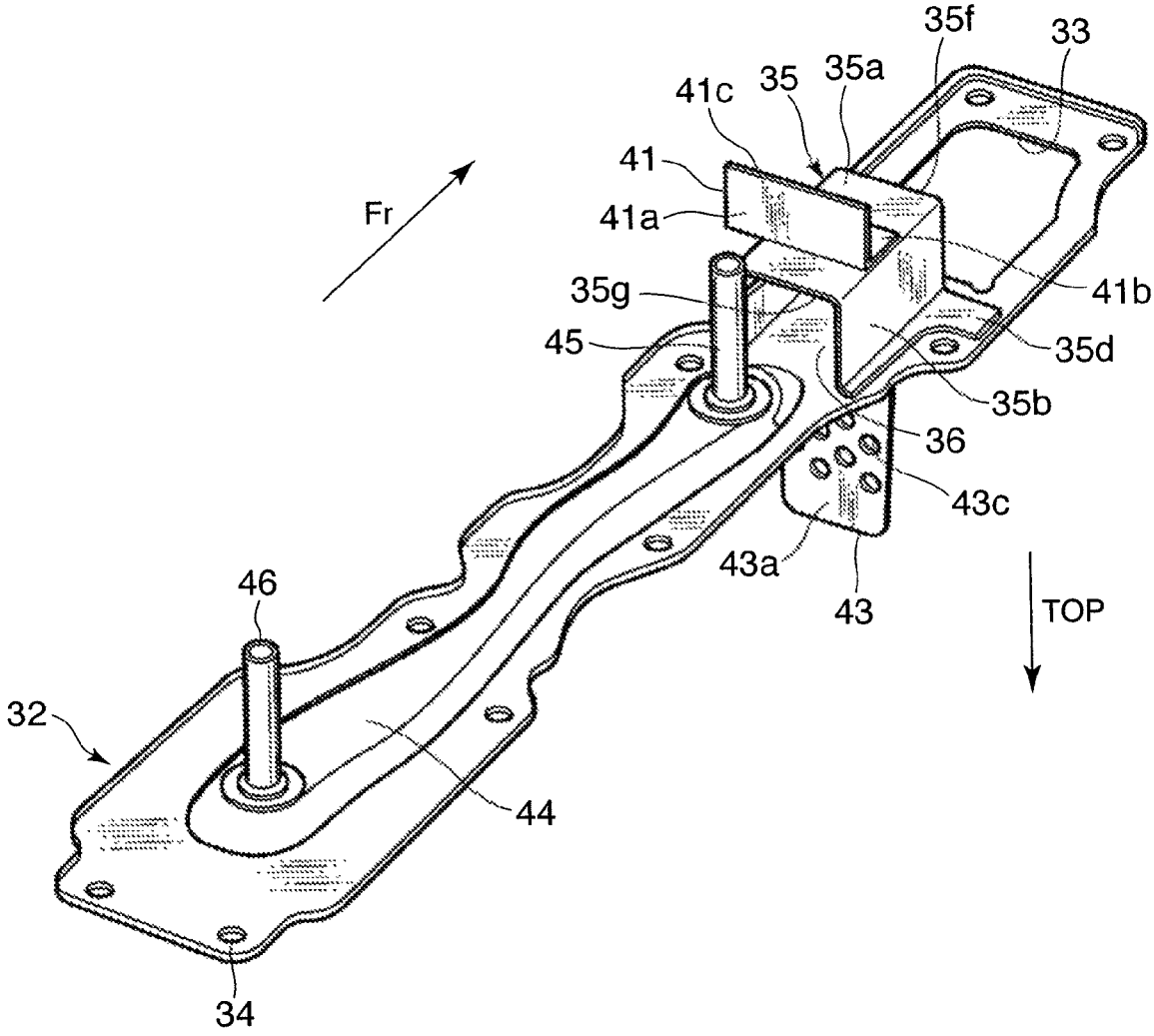
FIG. 8 is a perspective view of a base plate of the oil separator according to this invention when viewed obliquely from below.

Referring to FIG. 8, the base plate 32 is constructed from a substantially flat metal plate and has the same number of bolt holes 34 as the bolt holes 23 of the fixing seat 22. The base plate 32 is fixed to the horizontal partition 8 by bolts penetrating these bolt holes 23, 34. In a state where the base plate 32 is fixed to the horizontal partition 8, the base plate 32 closes the hole part 21 and functions as a part of the horizontal partition 8. FIG. 8 shows the base plate 32 in a state where it is turned upside down. The direction heading towards the lower end in the figure is oriented upward in the internal combustion engine when the base plate 32 is fixed to the horizontal partition 8.

Referring again to FIG. 2, the oil separator 31 comprises the base plate 32 and a housing 51 made of an aluminum alloy and fixed to the base plate 32. A blow-by gas inlet 33 is formed in the base plate 32 in the vicinity of the engine front end. The blow-by gas inlet 33 is located immediately above the upper transverse wall 26 when the base plate 32 is fixed to the horizontal partition 8. The blow-by gas in the gas introducing chambers 9*a*, 9*b*, 9*c* flows along the under surface of the horizontal partition 8 towards the engine front, temporarily accumulates in the depression 26*a* on the top surface of the transverse wall 26, and then flows into the housing 51 via the blow-by gas inlet 33. To encourage the blow-by gas to flow in this way, the blow-by gas inlet 33 is formed at the front part of the base plate 32 as shown in FIG. 2.

A blow-by gas outlet 52 is formed in the rear wall of the housing 51 located in the vicinity of the engine rear. A pressure control valve is connected to the blow-by gas outlet 52. After entering the housing 51 through the blow-by gas inlet 33, the blow-by gas flows rearward towards the blow-by gas outlet 52 in a space surrounded by the base plate 32 and the housing 51.

The reason why the blow-by gas inlet 33 is disposed in the vicinity of the engine front and the blow-by gas outlet 52 is disposed in the vicinity of the engine rear is that the oil separator 31 requires a sufficient length in the front-aft direction of the internal combustion engine to achieve a high oil separation efficiency.

A baffle plate 42 is provided integrally with the base plate 32 in the housing 51 so as to intercept the flow of blow-by gas which has entered through the blow-by gas inlet 33 and is flowing towards the blow-by gas outlet 52. The baffle plate 42 is formed by bending a part of the base plate 32 upward when the blow-by gas inlet 33 is formed in the base plate 32. The blow-by gas which has entered through the blow-by gas inlet 33 and is flowing through the housing 51 towards the blow-by gas outlet 52 is prevented from forming a linear flow towards the blow-by gas outlet 52 by the baffle plate 42 and forced to detour around the baffle plate 42 in order to reach the blow-by gas outlet 52.

A space in the housing 51 is divided into a front chamber 53 on the engine front side and a rear chamber 54 on the engine rear side by a flow path restricting plate 43A.

Figure 5:
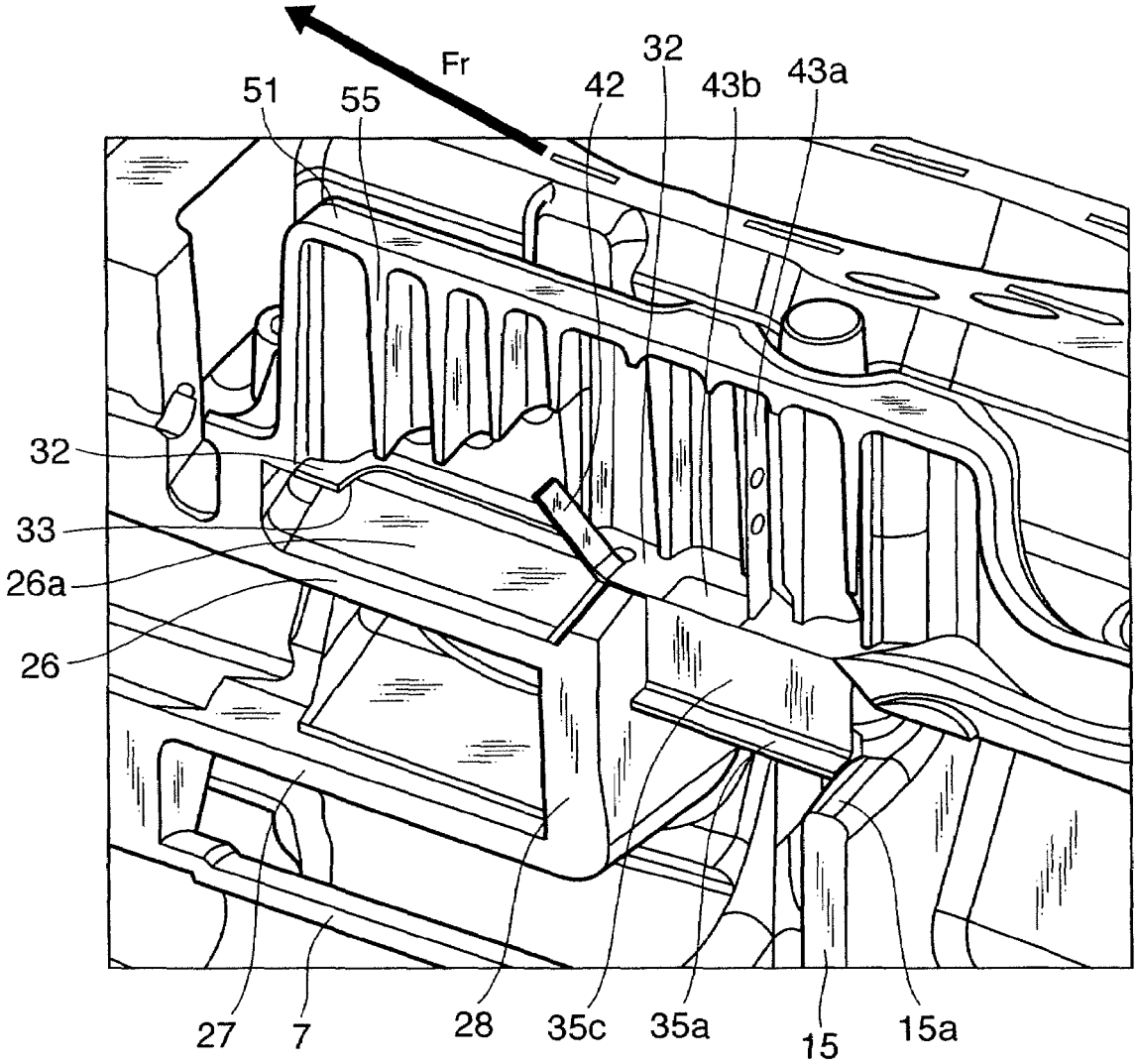
FIG. 5 is a perspective view of a cross-section of the blow-by gas-processing device cut along the line II-II in FIG. 1.
Figure 6:
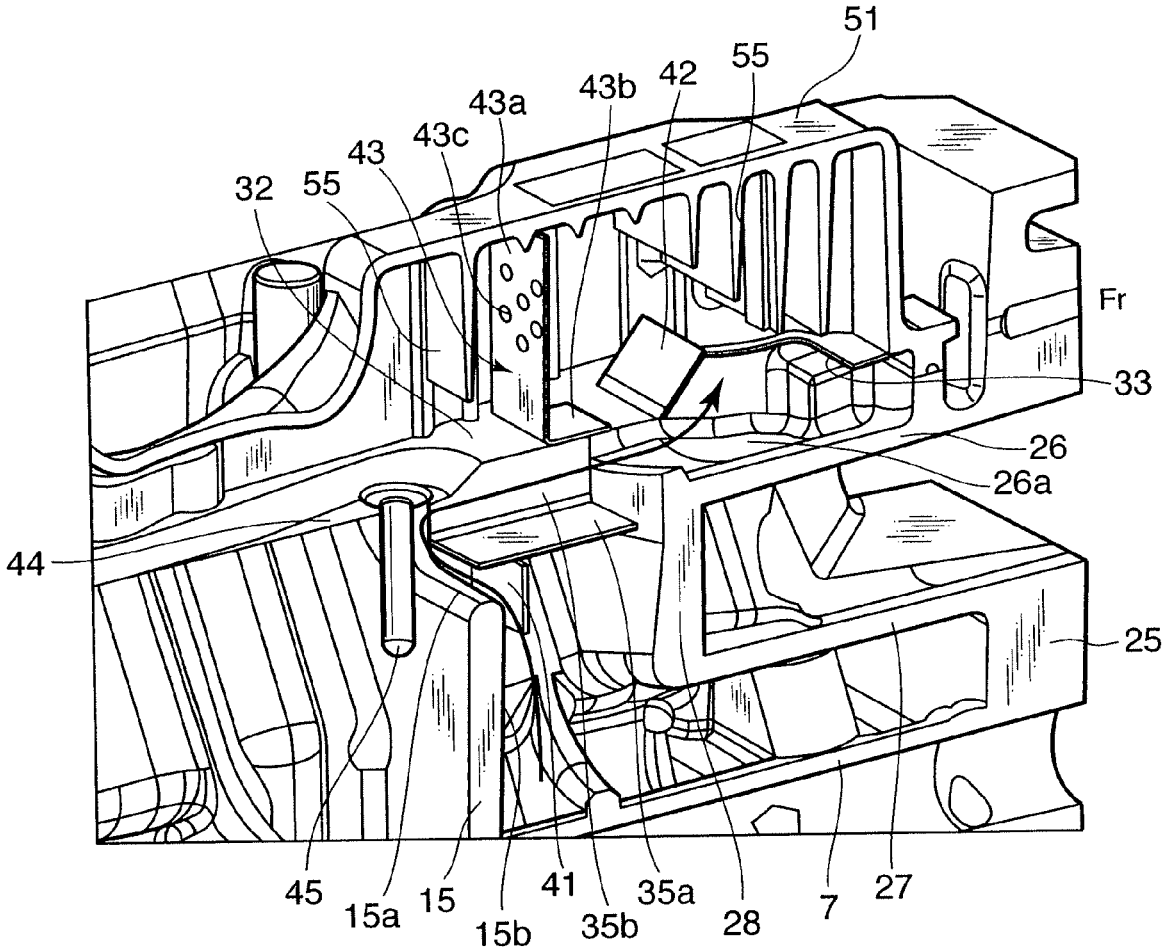
FIG. 6 is a perspective view of another cross-section of the blow-by gas-processing device cut along the line II-II in FIG. 1.
Figure 7:
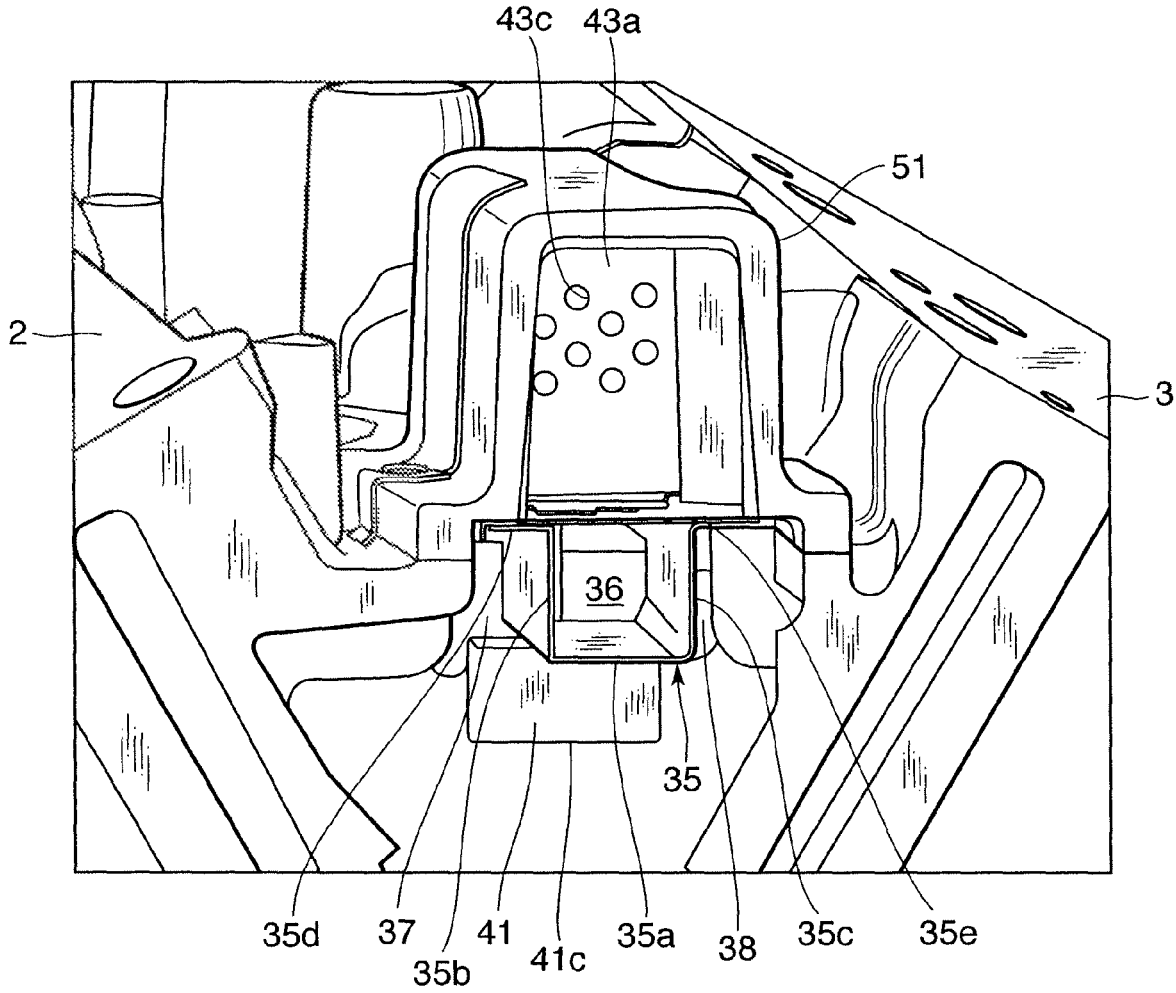
FIG. 7 is an enlarged perspective view of a cut surface of an oil separator and a first guide member according to this invention when viewed from an engine front of the internal combustion engine.

Referring to FIGS. 5 and 6, the flow path restricting plate 43 is constituted by a rectangular metal plate bent to 90 degrees so as to form a vertical part 43*a* and a horizontal part 43*b*. The vertical part 43*a* is disposed to intersect the blow-by gas flowing through the housing 51 from the blow-by gas inlet 33 to the blow-by gas outlet 52. The vertical part 43*a* has a plurality of circular holes 43*c*. The horizontal part 43*b* is fixed to the base plate 32 by means of welding or bonding. Each edge of the vertical part 43*a* contacts the inner surface of the housing 51.

The flow path restricting plate 43 has a function to increase the flow velocity of the blow-by gas which has entered the housing 51 from the blow-by gas inlet 33 and is flowing towards the blow-by gas outlet 52 by causing the blow-by gas to flow through the circular holes 43*c*.

A number of stick-like projections 55 are formed intensively in the front chamber 53 in a position immediately downstream of the front chamber 53. These stick-like projections 55 are constructed to project from the ceiling of the housing 51. The blow-by gas separates the oil component when it comes into contact with these stick-like projection 55.

Referring again to FIG. 2, a depression 44 is formed in the base plate 32 to collect the oil component that falls onto the base plate 32 in the housing 51. Further, a first oil dropping pipe 45 and a second oil dropping pipe 46 projecting downward are fixed to the base plate 32 so as to return the oil component accumulated in the depression 44 to the crank chambers 72 and 73 via the second gas introducing chamber 9*b* and the third gas introducing chamber 9*c*.

Referring to FIG. 2 and FIGS. 5-7, the blow-by gas processing device further comprises a guiding mechanism which guides a flow of blow-by gas from the first gas introducing chamber 9*a* to the blow-by gas inlet 33 in a direction heading away from the blow-by gas inlet 33. The guiding mechanism comprises a first guide member 35 and a second guide member 41.

The first guide member 35 is constituted by a horizontal box-shaped member which has a tip 35*f* contacting the upper part of the vertical wall 28 and another tip 35*g* opening onto a space above the first reinforcing rib 15. The upper part of the vertical wall 28 has an opening as described above and the tip 35*f* of the first guide member 35 contacts the vertical wall 28 so as to cover this opening. According to this construction of the first guide member 35 and the vertical wall 28, the blow-by gas inlet 33 is prevented from communicating directly with the first gas introducing chamber 9*a* and communicates only with an inner space 36 of the first guide member 35.

According to the above construction, a flow of blow-by gas from the first gas introducing chamber 9*a* to the blow-by gas inlet 33 is first oriented in a direction heading away from the blow-by gas inlet 33 along the outer periphery of the first guide member 35, whereupon the flow direction of the blow-by gas reverses at a point above the first reinforcing rib 15 such that the blow-by gas enters the inner space 36 of the first guide member 35 through the opening at the tip 35*g*. The blow-by gas then flows through the opening of the vertical wall 28 to reach the blow-by gas inlet 33.

Referring again to FIG. 8, the first guide member 35 is formed by bending a metal strip having a predetermined width. The first guide member 35 comprises a horizontal wall 35*a* which is parallel with the base plate 32 at a predetermined distance, two side walls 35*b* and 35*c* which are formed by bending the metal strip upward at both side ends of the horizontal wall 35*a* by 90 degrees, and the bases 35*d* and 35*e* which are formed by bending the metal strip horizontally outward by 90 degrees at upper ends of the side walls 35*b* and 35*c*. The bases 35*d* and 35*e* are fixed to the base plate 32 by means of welding or bonding. As a result, the inner space 36 having a substantially rectangular solid shape is formed by the horizontal wall 35*a*, the two side walls 35*b* and 35*c*, and the base plate 32.

Referring again to FIG. 7, predetermined gaps 37 and 38 are formed between the two side wall 35*b* and 35*c* and both side walls of the first gas introducing chamber 9*a*, respectively.

By first orienting the flow of blow-by gas which flows from the first gas introducing chamber 9*a* to the blow-by gas inlet 33 towards the second gas introducing chamber 9*b* via the gaps 37 and 38, a gas flow between the crank chamber 71 facing the cylinders 5A and 5D and the other crank chambers 72 and 73 is ensured, thereby reducing pumping loss in the internal combustion engine. If the first guide member 35 is not provided, a gas flow from the first crank chamber 71 to the second crank chamber 72 or the third crank chamber 7 is seldom formed since the blow-by gas in the first gas introducing chamber 9*a* flows immediately into the oil separator 31 from the blow-by gas inlet 33, and hence the pumping loss in the internal combustion engine cannot be reduced.

The shape of the first guide member 35 is not limited to a rectangular solid. The tip 35*g* located on the engine rear side may be shifted further towards the engine rear. The cross-section of the inner space 36 of the first guide member 35 is not necessarily limited to a rectangular shape. It can be a circular shape or triangular shape.

The tip 35*g* of the engine rear side of the first guide member 35 opens immediately above the upper end 15*a* of the first reinforcing rib 15. The flow of blow-by gas from the first gas introducing chamber 9*a* to the first guide member 35 can be throttled using the gap between the horizontal wall 35*a* and the upper end 15*a*. The blow-by gas throttled in this way blows out vigorously from the first gas introducing chamber 9*a* into the second gas introducing chamber 9*b*. The increased velocity of the blow-by gas enhances the directivity of the flow of blow-by gas in the direction heading away from the blow-by gas inlet 33. Further, the flow of blow-by gas from the second gas introducing chamber 9*b* to the blow-by gas inlet 33 through the inner space 36 of the first guide member 35 exerts a suction force on the blow-by gas in the first gas introducing chamber 9*a*.

Blow-by gas entering the first gas introducing chamber 9*a* through the fourth communicating hole 14 is directed to the engine rear along the transverse wall 27 and converges with the flow of blow-by gas which has entered the first gas introducing chamber 9*a* through the first communicating hole 11. After converging, the blow-by gas flows towards the engine rear through the gap formed between the under surface of the horizontal wall 35*a* of the first guide member 35 and the upper end 15*a* of the first reinforcing rib 15 and the gaps 37 and 38 on both sides of the first guide member 35.

A second guide member 41 is fixed to the horizontal wall 35*a* of the first guide member 35 so as to intercept the flow of blow-by gas along the under surface of the horizontal wall 35*a* towards the engine rear.

Referring again to FIG. 8, the second guide member 41 is made of metal plate. The second guide member 41 comprises an intercepting wall 41*a* in a rectangular shape projecting downward and a base 41*b* bent 90 degrees at an upper end of the intercepting wall 41*a*. The base 41*b* is fixed to the horizontal wall 35*a* of the first guide member 35 by welding or bonding.

The second guide member 41 is provided close to the engine front side of the first reinforcing rib 15, as shown in FIG. 2. A lower end 41*c* of the intercepting wall 41*a* reaches a point lower than the upper end 15*a* of the first reinforcing rib 15 such that the intercepting wall 41*a* overlaps a wall face 15*b* of the engine front side of the first reinforcing rib 15. A narrow flow passage is thereby formed between the intercepting wall 41*a* and the wall face 15*b*.

According to the above arrangement of the second guide member 41, the blow-by gas in the first gas introducing chamber 9*a* collides with the intercepting wall 41*a* before reaching the gap between the under surface of the horizontal wall 35*a* of the first guide member 35 and the upper end 15*a* of the first reinforcing rib 15. This collision brings about a favorable effect in terms of separating the oil component from the blow-by gas.

The blow-by gas which has entered the second gas introducing chamber 9*b* from the first gas introducing chamber 9*a* by detouring the intercepting wall 41*a* converges with the blow-by gas in the second gas introducing chamber 9*b*. The converged blow-by gas flows into the inner space 36 of the first guide member 35 while colliding with the horizontal partition 8 and the base plate 32, which function as a ceiling of the second gas introducing chamber 9*b*, and then flows towards the engine front through the inner space 36. Having entered the second gas introducing chamber 9*b* from the first gas introducing chamber 9*a*, the blow-by gas reverses its flow direction in the second gas introducing chamber 9*b* towards the engine front, or in other words, as shown by an arrow in FIG. 6, reverses its flow direction in the vicinity of the upper end 15*a* of the first reinforcing rib 15 due to a pushing force exerted by the blow-by gas flowing from the second gas introducing chamber 9*b* to the inner space 36 of the first guide member 35, and then flows towards the engine front through the inner space 36 of the first guide member 35.

As described above, all the blow-by gas in the first gas introducing chamber 9*a* which is the nearest gas introducing chamber to the blow-by gas inlet 33 is first directed towards the second gas introducing chamber 9*b* and then caused to reverse its flow direction so as to flow into the inner space 36 of the first guide member 35. A centrifugal force accompanying this direction reversal of the flow of blow-by gas acts on the blow-by gas so as to separate the oil component contained therein.

The blow-by gas flows from the inner space 36 of the first guide member 35 into the housing 51 via the depression 26*a* formed in the top surface of the transverse wall 26, and then flows through the blow-by gas inlet 33.

While flowing towards the engine rear in the housing 51, the blow-by gas collides with the baffle plate 42, changes its flow direction upward, and is caused to flow between the plurality of stick-like projections 55. On this route, the oil component in the blow-by gas adheres to the stick-like projections 55 and then drops downward.

After almost all of the oil component has been separated in the front chamber 53 in the housing 51, the blow-by gas passes through the circular holes 43*c* in the flow path restricting plate 43A and flows into the rear chamber 54. The blow-by gas increases in velocity by passing through the circular holes 43*c*, and therefore collides with the stick-like projections 55 in the rear chamber 54, thereby further separating the oil component.

After the oil component is separated completely in this way, the blow-by gas flows out through the blow-by gas outlet 52 towards the pressure control valve.

The oil separated from the blow-by gas in the front chamber 53 and the rear chamber 54 in the housing 51 is collected in the depression 44 of the base plate 32. The oil separated from the blow-by gas in the front chamber 53 is returned mainly via the first oil dropping pipe 45 to the second gas introducing chamber 9*b*. The oil separated from the blow-by gas in the rear chamber 54 is returned mainly via the second oil dropping pipe 46 to the third gas introducing chamber 9*c*. The oil in the second gas introducing chamber 9*b* and the third gas introducing chamber 9*c* drops through the communicating holes 12 and 13 into the crank chambers 72 and 73.

The contents of Tokugan 2007-272534, with a filing date of Oct. 19, 2007 in Japan, are hereby incorporated by reference.

Although the invention has been described above with reference to a certain embodiment, the invention is not limited to the embodiment described above. Modifications and variations of the embodiment described above will occur to those skilled in the art, within the scope of the claims.

For example, in the embodiment described above, the blow-by gas inlet 33 is provided on the engine front side of the housing 51 and the blow-by gas outlet 52 is provided on the engine rear side of the housing 51. However, it is possible to provide the blow-by gas inlet 33 on the engine rear side of the housing 51 and provide the blow-by gas outlet 52 on the engine front side of the housing 51.

The embodiments of this invention in which an exclusive property or privilege is claimed are defined as follows:

1. An internal combustion engine, comprising:

a plurality of crank chambers; and a blow-by gas processing device configured to collect blow-by gas from the plurality of crank chambers, wherein the blow-by gas processing device comprises:

an oil separator configured to separate an oil component contained in the blow-by gas, the oil separator comprising a blow-by gas inlet in a vicinity of an engine front or an engine rear;

gas introducing chambers which are disposed between the crank chambers and the blow-by gas inlet;

communicating holes, wherein each communicating hole connects one of the gas introducing chambers to a corresponding crank chamber, wherein the communicating holes comprise a specific communicating hole which is closest to the blow-by gas inlet relative to a rest of the communicating holes, wherein the gas introducing chambers comprise a specific gas introducing chamber connected to the specific communicating hole and an adjacent gas introducing chamber which is adjacent to the specific gas introducing chamber; and guiding members configured to guide the blow-by gas from the gas introducing chambers to the blow-by gas inlet, the guiding members comprising a member configured to guide the blow-by gas from the specific communicating hole to the adjacent gas introducing chamber via the specific gas introducing chamber in a direction heading away from the blow-by gas inlet, and a member configured to guide the blow-by gas from the adjacent gas introducing chamber to the blow-by gas inlet.

2. The internal combustion engine according to claim 1, wherein the guiding members form a channel-shaped member which comprises a passage connecting the adjacent gas introducing chamber and the blow-by gas inlet, and wherein the channel-shaped member has an opening above a gap which connects the specific gas introducing chamber and the adjacent gas introducing chamber such that the blow-by gas in the specific gas introducing chamber flows into the opening after flowing on an outside of the channel-shaped member.

3. The internal combustion engine according to claim 2, further comprising a baffle plate configured to intercept a flow of blow-by gas on the outside of the channel-shaped member.

4. The internal combustion engine according to claim 3, wherein the gap is formed by a rib which delimits the specific gas introducing chamber and the adjacent gas introducing chamber, and wherein the baffle plate projects downward from the channel-shaped member to cover the gap and overlap the rib while maintaining a distance from the rib.

5. The internal combustion engine according to claim 1, wherein the blow-by gas inlet is located in the vicinity of the engine front, and wherein a blow-by gas outlet is located in the vicinity of the engine rear.

6. The internal combustion engine according to claim 1, wherein the internal combustion engine is a V-shaped internal combustion engine provided with two cylinder banks, wherein the plurality of crank chambers are shared by the two cylinder banks, wherein the gas introducing chambers are formed between the two cylinder banks above the plurality of crank chambers, and wherein the oil separator is disposed above the gas introducing chambers.

7. An internal combustion engine, comprising:

a plurality of crank chambers; and a blow-by gas processing device configured to collect blow-by gas from the plurality of crank chambers, wherein the blow-by gas processing device comprises:

an oil separator configured to separate an oil component contained in the blow-by gas, the oil separator comprising a blow-by gas inlet in a vicinity of an engine front or an engine rear;

gas introducing chambers disposed between the crank chambers and the blow-by gas inlet;

communicating holes, wherein each communicating hole connects one of the gas introducing chambers to a corresponding crank chamber, wherein the communicating holes comprise a specific communicating hole which is closest to the blow-by gas inlet relative to a rest of the communicating holes, wherein the gas introducing chambers comprise a specific gas introducing chamber connected to the first communicating hole and an adjacent second gas introducing chamber which is adjacent to the first gas introducing chamber; and a guiding member configured to guide the blow-by gas from the first communicating hole to the second gas introducing chamber via the first gas introducing chamber in a direction heading away from the blow-by gas inlet, wherein the guiding member is also configured to guide the blow-by gas from the second gas introducing chamber to the blow-by gas inlet.

8. The internal combustion engine according to claim 7, wherein the guiding member comprises a channel-shaped member which comprises a passage connecting the second gas introducing chamber and the blow-by gas inlet, and wherein the channel-shaped member has an opening positioned above a gap which connects the first gas introducing chamber and the second gas introducing chamber such that the blow-by gas in the first gas introducing chamber flows into the opening after flowing on an outside of the channel-shaped member.

9. The internal combustion engine according to claim 8, further comprising a baffle plate configured to intercept a flow of blow-by gas on the outside of the channel-shaped member.

10. The internal combustion engine according to claim 9, wherein the gap is formed by a rib which delimits the first gas introducing chamber and the second gas introducing chamber, and wherein the baffle plate projects downward from the channel-shaped member to cover the gap and overlap the rib while maintaining a distance from the rib.

11. The internal combustion engine according to claim 7, wherein the blow-by gas inlet is located in the vicinity of the engine front, and wherein a blow-by gas outlet is located in the vicinity of the engine rear.

12. The internal combustion engine according to claim 7, wherein the internal combustion engine is a V-shaped internal combustion engine provided with two cylinder banks, wherein the plurality of crank chambers are shared by the two cylinder banks, wherein the first and second gas introducing chambers are formed between the two cylinder banks above the plurality of crank chambers, and wherein the oil separator is disposed above the first and second gas introducing chambers.

* * * * *